US008833962B2

(12) United States Patent
Ko

(10) Patent No.: US 8,833,962 B2
(45) Date of Patent: Sep. 16, 2014

(54) CLIP-ON POCKET LIGHT WITH SLIDEABLE HINGE JOINT

(76) Inventor: Wai-Shing Peter Ko, Peachtree City, GA (US)

( * ) Notice: Subject to any disclaimer, the term of this patent is extended or adjusted under 35 U.S.C. 154(b) by 247 days.

(21) Appl. No.: 13/491,006

(22) Filed: Jun. 7, 2012

(65) Prior Publication Data

US 2013/0329412 A1 Dec. 12, 2013

(51) Int. Cl.
*F21L 4/04* (2006.01)

(52) U.S. Cl.
CPC ..... *F21L 4/045* (2013.01)
USPC ..... 362/199; 362/196; 362/197; 362/200; 362/419; 362/427

(58) Field of Classification Search
CPC ..... F21L 4/005; F21L 4/022; F21L 4/027
USPC ..... 362/196–197, 199–200, 418–419, 427
See application file for complete search history.

(56) References Cited

U.S. PATENT DOCUMENTS

| | | | | |
|---|---|---|---|---|
| 3,953,722 | A | 4/1976 | Stick | |
| 4,598,340 | A * | 7/1986 | Dwosh et al. | 362/98 |
| 5,154,483 | A | 10/1992 | Zeller | |
| 5,410,457 | A | 4/1995 | Parker | |
| 5,442,528 | A | 8/1995 | Vandenbelt | |
| 5,541,816 | A | 7/1996 | Miserendino | |
| 6,213,618 | B1 | 4/2001 | Dobbin et al. | |
| 7,306,348 | B2 | 12/2007 | Quittner | |
| 7,309,137 | B2 | 12/2007 | Chan | |
| 7,478,917 | B2 * | 1/2009 | Yu | 362/188 |

* cited by examiner

*Primary Examiner* — Sean Gramling

(57) ABSTRACT

A portable pocket light, comprising three sections; (1) a main body containing an electric circuitry board, battery compartment, and a power switch; (2) a lamp section containing a light source, a lens, and a means for rotatably attaching said lamp section to the main body and facilitating rotation of said lamp section in a 300 degree arc about the an extended axis of said main body, and (3) a sheath section comprising two prongs, and an axial means for rotating said main body an unimpaired 360 degrees within the confines of the two sheath prongs. The two prongs further facilitate a self-standing base by means of which the pocket light may rest on a surface and provide stable, adjustably aimed illumination in a plurality of directions and orientations. The pocket light is fabricated with an integral spring-loaded clip which enables temporary attachment of the pocket light to the brim of a wearer's cap, a shirt pocket, or other stable object. Overall, the disclosed pocket light provides low power consumption, and adequately bright light in either a hands-free or a handheld application.

18 Claims, 13 Drawing Sheets

CLIP-ON POCKET LIGHT WITH SLIDEABLE HINGE JOINT

CROSS-REFERENCES TO RELATED APPLICATIONS

Not Applicable

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION (1) Field of the Invention

The inventive concept is within the field of small, portable pocket lights that may be conveniently carried on one's person and used for illumination in a variety of situations where space is limited. Generally, such lights are popular but they frequently suffer from several drawbacks. Typically, the aiming of the light is limited and not adjustable relative to the main body of the light case. Most pocket lights of this genre are limited to one specific application, such as reading books, road maps, or small documents. The vast majority of such lights cannot aim their illumination from an assortment of positions, provide angled light beam focus, and easily change light direction while free-standing, as can the inventive concept disclosed herein.

(2) Description of the Related Art, Including Information Disclosed Under 37 CFR 1.97 and 1.98

Pocket lights with clips are known in the industry. For example, a pocket light designed to fit over the top of the shirt pocket of a user is disclosed in U.S. Pat. No. 7,306,348. Many pocket lights are bulky and comprise a great many components. For example, U.S. Pat. No. 7,309,137 has two joints and a telescope arm which consists of several parts, but the device can only provide a relatively limited range of light beam directions.

Other documents presenting similar products include U.S. Pat. No. 5,410,457 (Parker, 1995), disclosing a small-sized versatile-use flashlight which has a hand holdable battery housing with a cap being pivotally mounted on said housing. Within the cap is included appropriate electrical connections to supply battery power to a light bulb mounted within a light bulb housing. The light bulb housing is pivotally mounted onto the cap with the plane of the pivotal movement of the light bulb housing being perpendicular to the plane of the pivotal movement of the cap relative to the battery housing.

U.S. Pat. No. 5,442,528 (Vandenbelt, 1995) is an invention utilizing a neck mechanism possessing a memory effect that repeatedly returns a light-bearing neck to its original curved position when extended. The mechanism features a light-bearing neck which can be retracted to fit within the body of the bookmark and can also be pushed to extend out of the bookmark, causing the light to automatically energize above the pages of a book when reading.

In general, the drawback of these and other prior art lighting devices is that their designs restrict them to a single type of use or purpose, either as a flashlight, a headlight, or a reading light. Most of them are not configured to provide multi-functional application. Having a single light device with multi-functional applications can save space and money for the general consumer.

As a result, a need exists for a lighting device having multi-functionality or uses, such as a flashlight, a hat light, a pocket light and a task light, which will overcome the drawbacks of the prior art without introducing any new problems in place thereof.

BRIEF SUMMARY OF THE INVENTION

The inventive concept disclosed is essentially a three-member pocket light device. The first member comprises a main body which is rotatingly connected to a second member comprising a lamp section, said second member further having a battery-powered lamp within, and a third member comprising a sheath. The sheath comprises an upper prong and a lower prong, mutually parallel to each other. Between the two prongs of the sheath is an opening sufficient dimension to slidingly and pivotably connect to, and encompass, the main body. When all three members are deployed and positioned within the limits of their various travel ranges, the assemblage of the first, second, and third members of the device provides a wide variety of member-relative positions, orientations, and device placements to accomplish almost any illumination coverage that a user may need.

The device may be conveniently compacted into a unit having the shape of a rectangular box, with the main body and the lamp section being symmetrically enclosed between the upper and lower prongs of the sheath member. A spring-loaded clip integral to the upper prong enables a user to effectively use the pocket light by attaching it to shirt pocket, a cap brim, or other suitable object.

DETAILED DESCRIPTION OF THE INVENTION

Figure 1A:
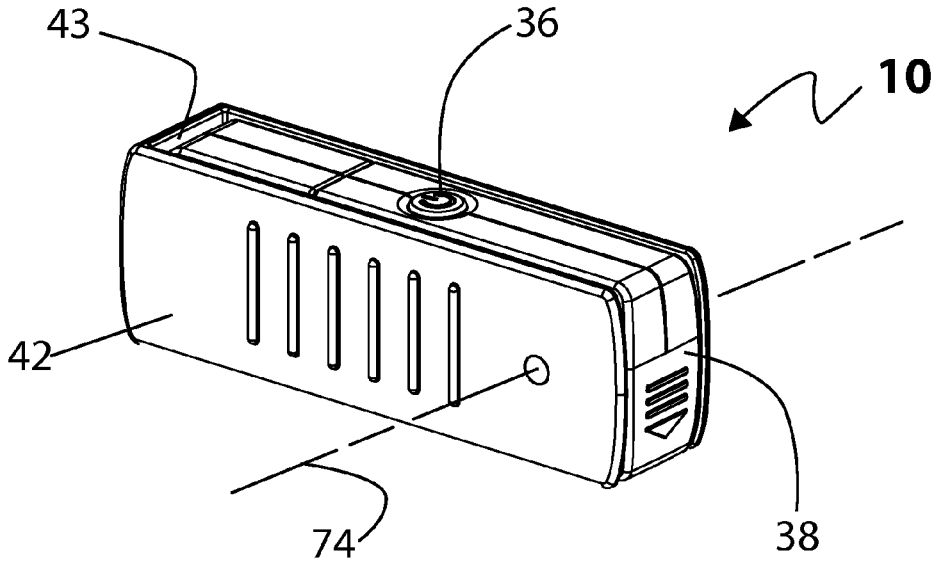
FIG. 1A is a perspective view of the pocket light with the lamp section and main body section in storage position within the prongs.

For matters of illustration and clarity of understanding, the following sections will be descriptive of the preferred embodiment of the inventive concept. An overall understanding of the general inventive concept can be acquired by viewing FIG. 2, which presents the main body 18 and the lamp section 15 in a stowed configuration, mated to each other. The main body 18 comprises a main front cover 30 and a main rear cover 32 and a slidable battery cover 38 fitted onto both main front and main rear covers 30, 32. A rear oval channel 35 is shown constructed within the rear main cover 32. A corresponding front cover oval channel 33 (out of view) is constructed in an exact same manner and having dimensions precisely coinciding with the rear cover oval channel 35.

Figure 2:
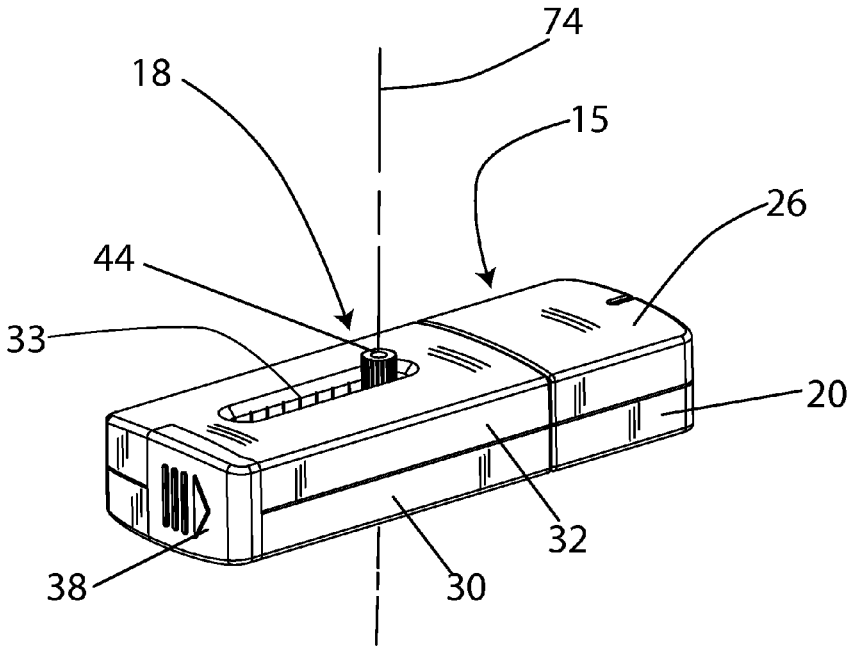
FIG. 2 is a perspective view of the lamp, main body section, and grommet separated from the sheath member, with the lamp section and main body section are in a semi-storage position.

Further shown in FIG. 2 is a hollow cylindrical grommet 44, placed upright within the rear oval channel 35. The cross-sectional diameter of the grommet 44 is approximately equivalent to the short dimension width of the front and rear oval channels 33, 35. When the main body 18 is completely assembled, the main body 18 may be moved back and forth a distance equivalent to the long dimension of the front cover oval channel 35, and perpendicularly to the axis of the grommet 44. The grommet 44 serves as a protective cover and a rotational means for the main body 18 about the axis of a threaded fastener 46, shown in FIG. 2A. The common axis of the threaded fastener 46 and the grommet 44 extend perpendicularly from the fastener guide 16, shown in FIG. 2A to an integral slab nut 47 (not shown) integral to the interior surface of the upper prong 41.

FIG. 2 further shows the lamp section 15, having a front lamp cover 20 and a rear lamp cover 26. The lens 22 (out of view) of the pocket light 10 is contained within the front lamp cover 20. The lamp section 15 and the main body 18 are releasably joined together by the pivotal union of a lamp section neck 66, 68 (shown in FIG. 3A), and main body collar 62, 64 (shown in FIG. 3A and FIG. 4). This union, being an element of the preferred embodiment is referred to as the "neck-collar combination" and will be explained in detail within this document. The neck-collar combination allows the lamp section 15 to be rotated within a three hundred (300) degree arc, about the extended longitudinal axis 73 of the main body 18.

Figure 2A:
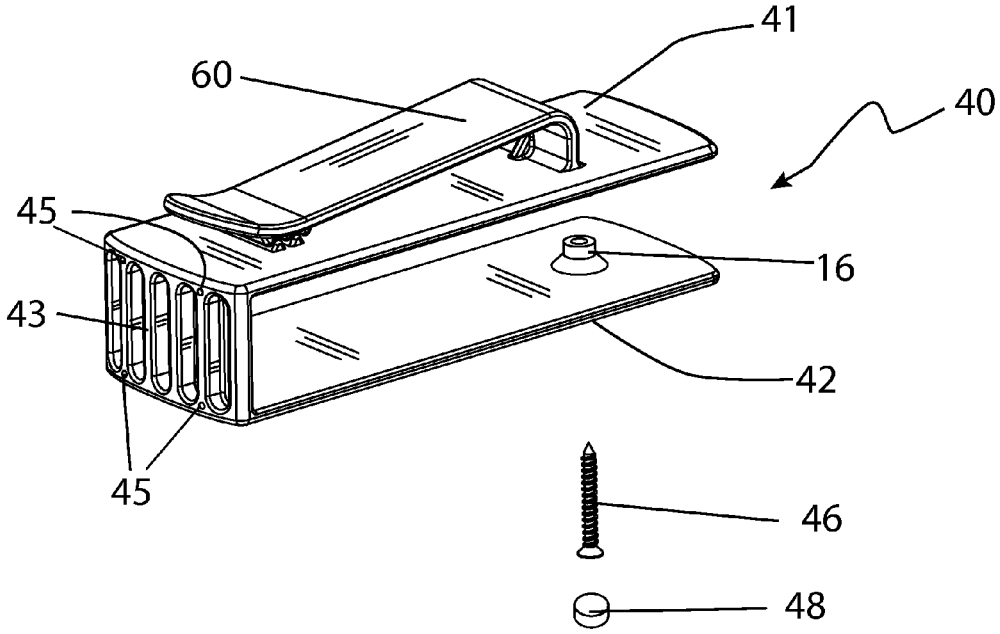
FIG. 2A depicts the two-pronged sheath member and its associated threaded fastener and cap.

FIG. 2A illustrates the sheath 40 which is constructed so as to enclose, lengthwise, the main body 18 and the lamp section 15 between the upper prong 41 and the lower prong 42 of the sheath 40. In a fully-stowed configuration, the con-joined main body 18 and lamp section 15 are placed lengthwise within the sheath 40. The axis of the previously described grommet 44 is aligned with the center of a fastener guide 16 integral to the lower prong 42. In this manner, a threaded fastener 46 is then inserted upwards through a sheath hole 49 (shown in FIG. 3A) co-located with the fastener guide 16 in the lower prong 42. The threaded fastener 46 passes through the grommet 44 and is then rotatingly secured into a slab nut 47 (shown in FIG. 3) which is integral to the upper prong 41 of the sheath 40. A cap 48 is inserted into the sheath hole 49 to cover the head of the threaded fastener 46.

Figure 5:
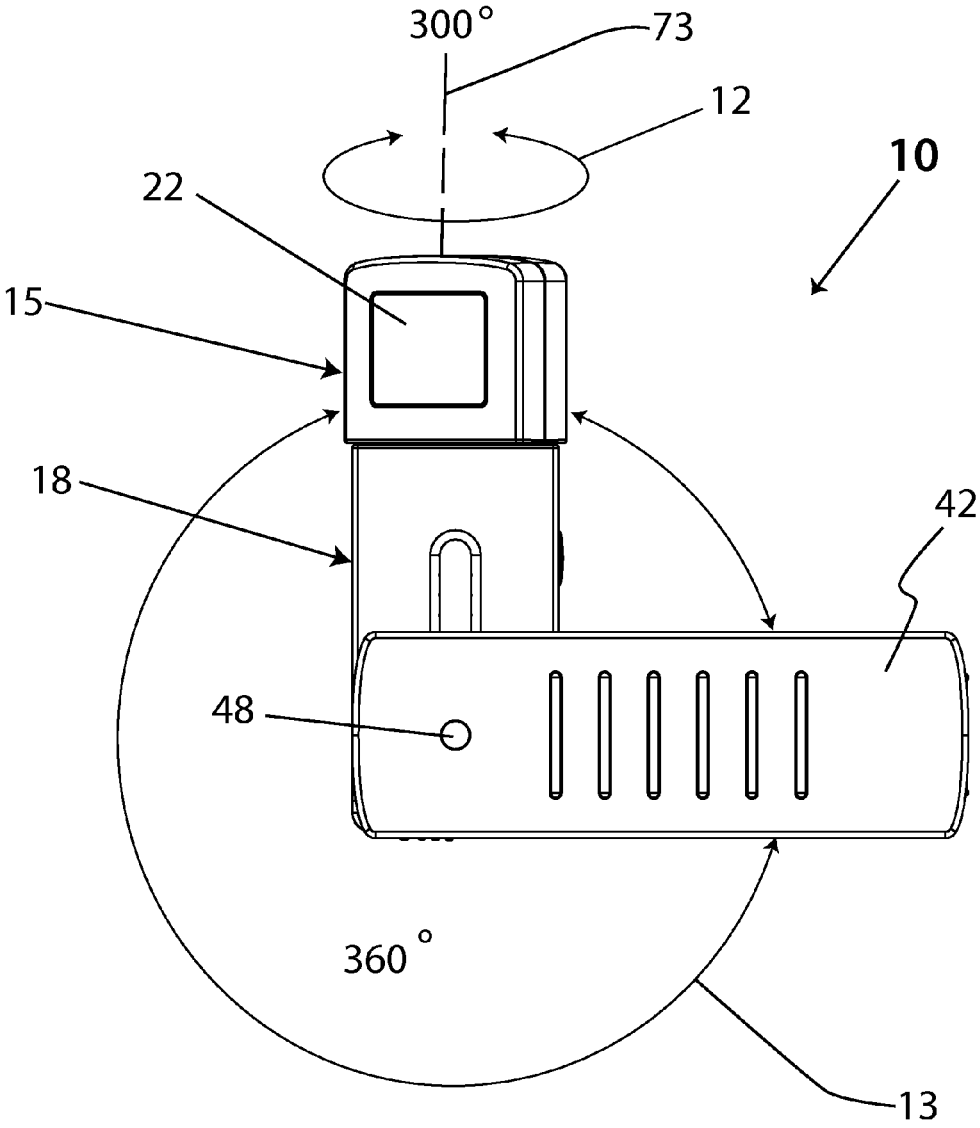
FIG. 5 is an elevation view of the present invention depicting the arc of travel rotation of the lamp section with respect to the main body and the rotation of the combined lamp section and main body section with respect to the sheath.

Once the pocket light 10 is secured within the sheath 40, the main body 18 is enabled to rotate, in a complete 360 degree arc, about the axis of the threaded fastener 46 and the grommet 44, and within the confines of the upper and lower prongs 41, 42, as is more fully shown in FIG. 5. A spring-loaded clip 60 is attached to the upper prong 41 of the sheath 40 to facilitate attachment of the pocket light 10 to a person's shirt pocket, the brim of a cap, or other suitable object.

Figure 7A:
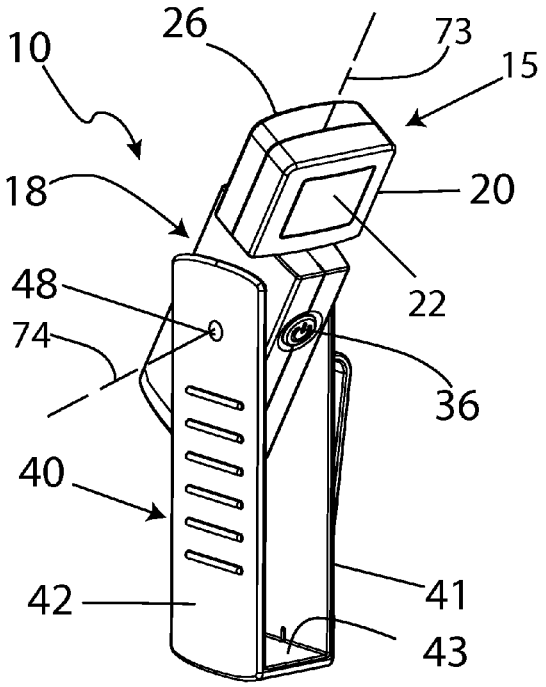
FIG. 7A is the perspective view of the pocket light in one of the self-standing mode positions with the light standing on the footings of the sheath.

A general idea of the variety of combinations of pocket light 10 orientations is depicted in FIGS. 7A, 7B, 7C, and 7D. In FIG. 7A, the pocket light 10 is shown deployed by means of the sheath 40 standing upright on its footings 45, said footings out of view underneath the sheath back 43. The main body 18 has been extended a short distance by sliding the oval channel 33, within the sheath 40 and perpendicularly to the grommet 44 axis. Afterwards, the main body 18 is then rotated approximately 135 degrees counter clockwise about the grommet axis 74, one end of said grommet 44 being co-axial with the circular cap 48 shown on the lower prong 42. The lamp section 15 has been rotated 90 degrees about the main body collar axis 73, thereby placing the lens 22 in a position to cast a beam of illumination in the direction indicated.

Figure 7B:
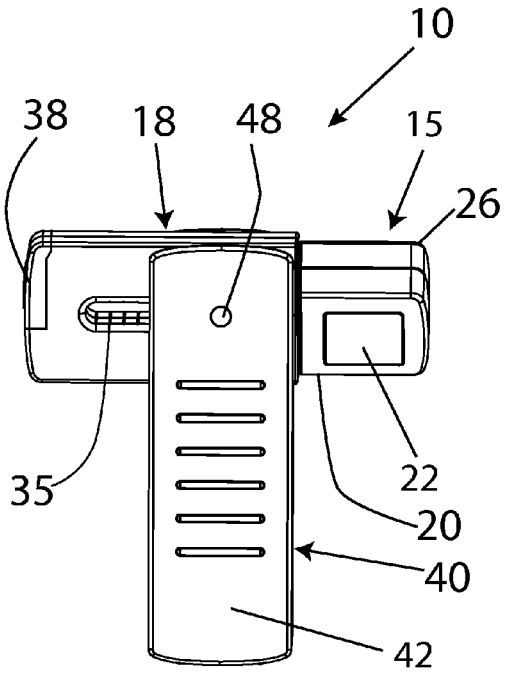
FIG. 7B is the perspective view of the pocket light in one of the self-standing mode positions.

In FIG. 7B, the pocket light 10 is depicted in a variation of FIG. 7A, with the main body 18 having been rotated 45 degrees in a downward direction about the grommet 44 axis as represented by the cap 48. Further, in FIG. 7B, the lamp section 15 has been rotated approximately 45 degrees clockwise about the main body collar axis 73.

Figure 7C:
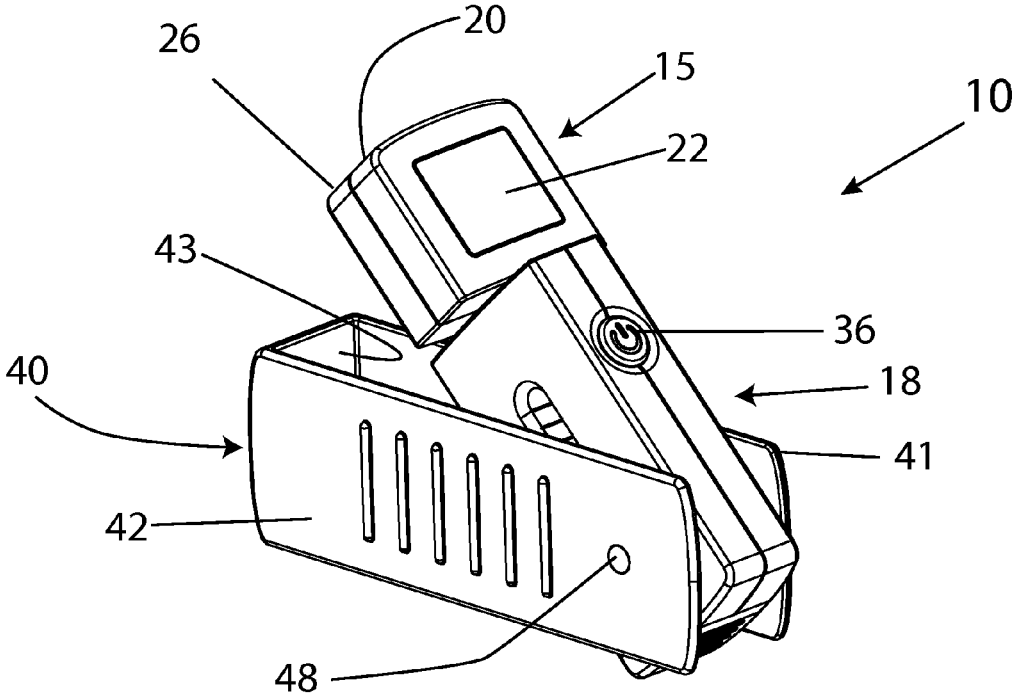
FIG. 7C is the perspective view of the pocket light in one of the self-standing mode positions for vertical light aiming

In FIG. 7C, the main body 18 depicted in FIG. 7A has been rotated counter-clockwise from right to left in FIG. 7A approximately 90 degrees about the axis 74 of the internal grommet 44 (the end of said axis penetrating the cap 48) and slide in a downward direction about the grommet 44 axis. Subsequently, the sheath 40 is rotated 90 degrees (from left to right in FIG. 7A) and positioned on a surface and resting on the parallel edges of the upper prong 41 and the lower prong 42, as is shown in FIG. 7B.

Figure 7D:
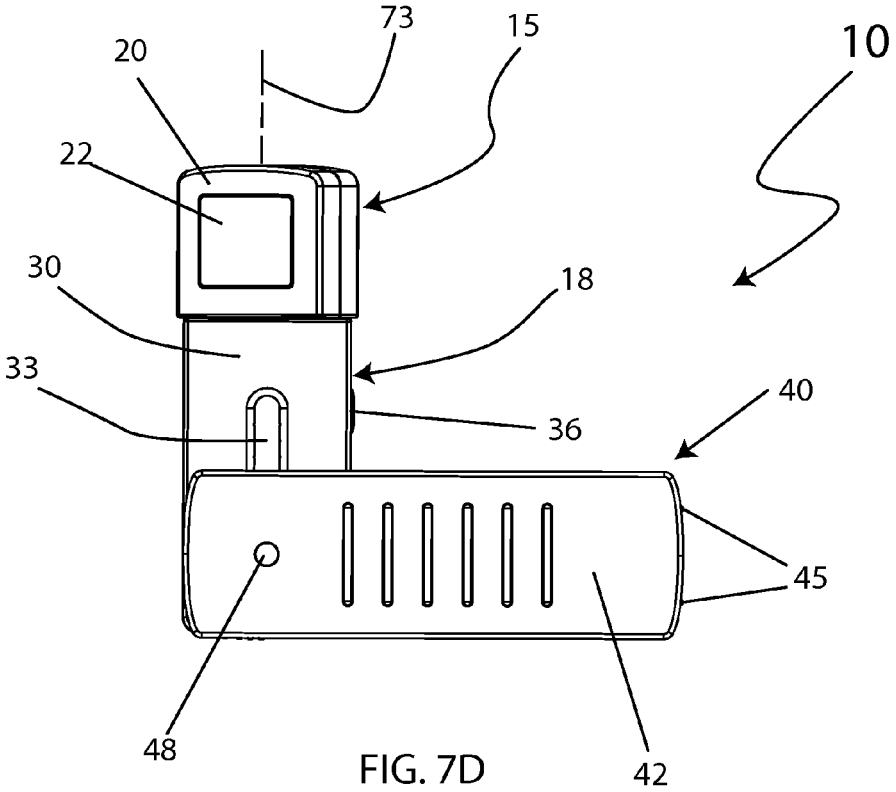
FIG. 7D is the perspective view of the pocket light in another of the self-standing mode positions with the light standing on the two prongs of the sheath.

In FIG. 7D, the main body 18 depicted in FIG. 7A has been rotated counter-clockwise 90 degree about the grommet axis 74 and self standing on the two prongs of the sheath. Further, in FIG. 7D, the lamp section 15 has been rotated approximately 15 degrees clockwise about the main body collar axis 73.

Figure 1B:
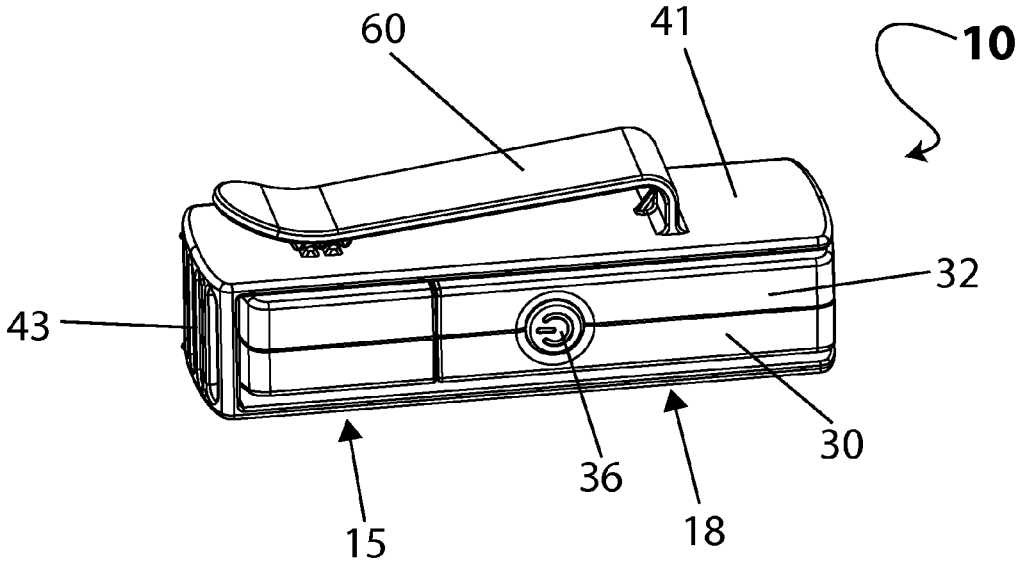
FIG. 1B is a perspective view of a pocket light with an integral clip showing on one side of the sheath member.
Figure 8A:
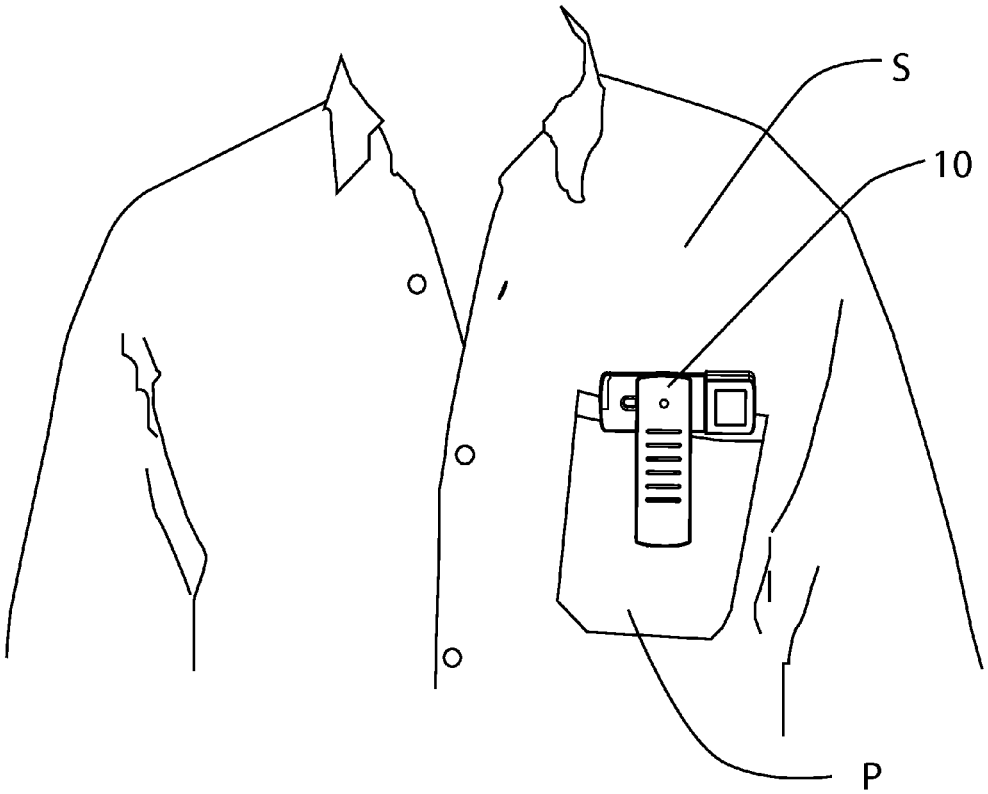
FIG. 8A depicts a user's shirt having a front pocket to which the pocket light is attached by means of the pocket light clip.
Figure 8B:
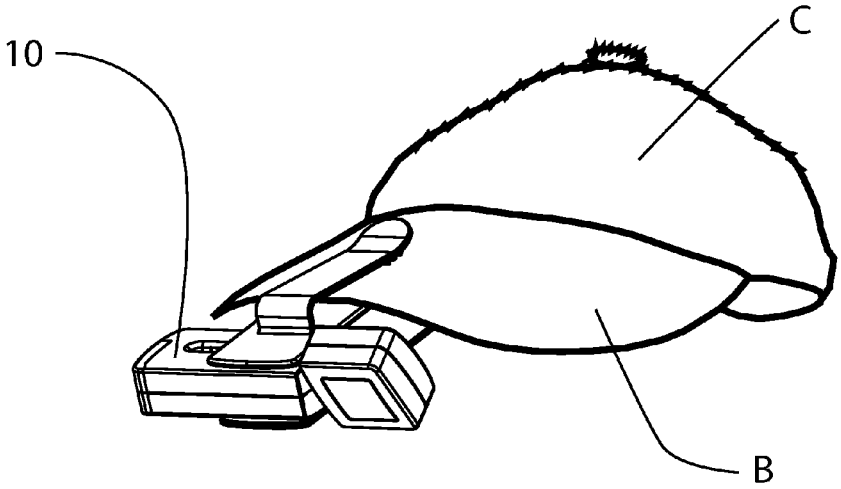
FIG. 8B is a perspective view of a cap wherein the pocket light is clipped onto the brim of the cap.
Figure 9A:
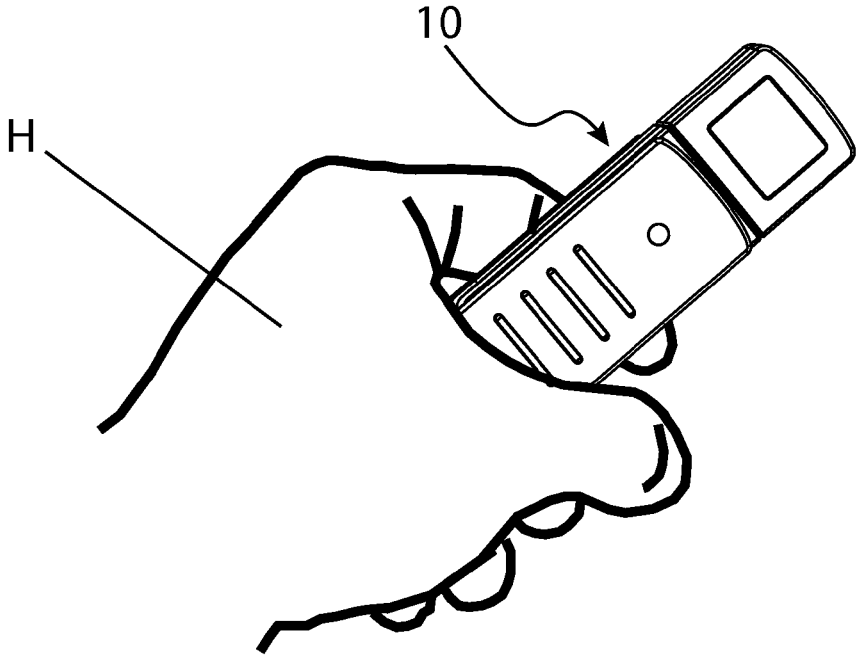
FIG. 9A presents a view of a user's hand holding the pocket light.
Figure 9B:
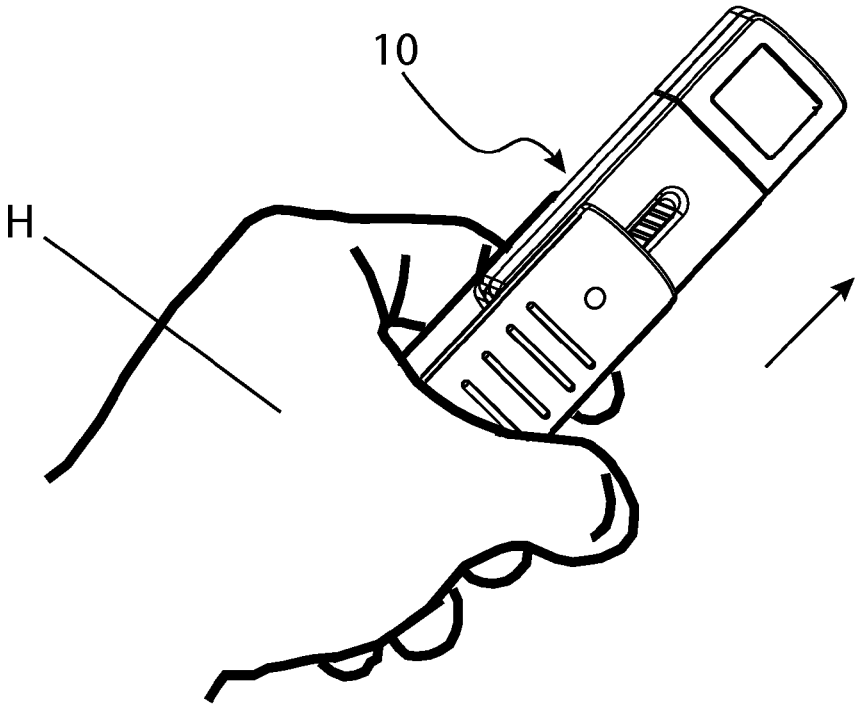
FIG. 9B illustrates a user's hand holding the pocket light with the lamp section and main body in extended position.

Views of the pocket light 10 in its stowed, or compacted configuration are presented in FIG. 1A and FIG. 1B. The pocket light clip 60 shown in FIG. 1B is a useful feature that enables a user to actively use the pocket light 10 while affixed to a shirt S pocket of the user, as depicted in FIG. 8A, or attached to the brim of a baseball cap C, as illustrated in FIG. 8B. In either mode of clip-on use, the user's hands are free to perform necessary tasks while the positioning of the pocket light 10 provides illumination in the task area. FIG. 9A and FIG. 9B illustrate the relative size of the pocket light in relation to a user's hand H as a handheld task light application.

Figure 3A:
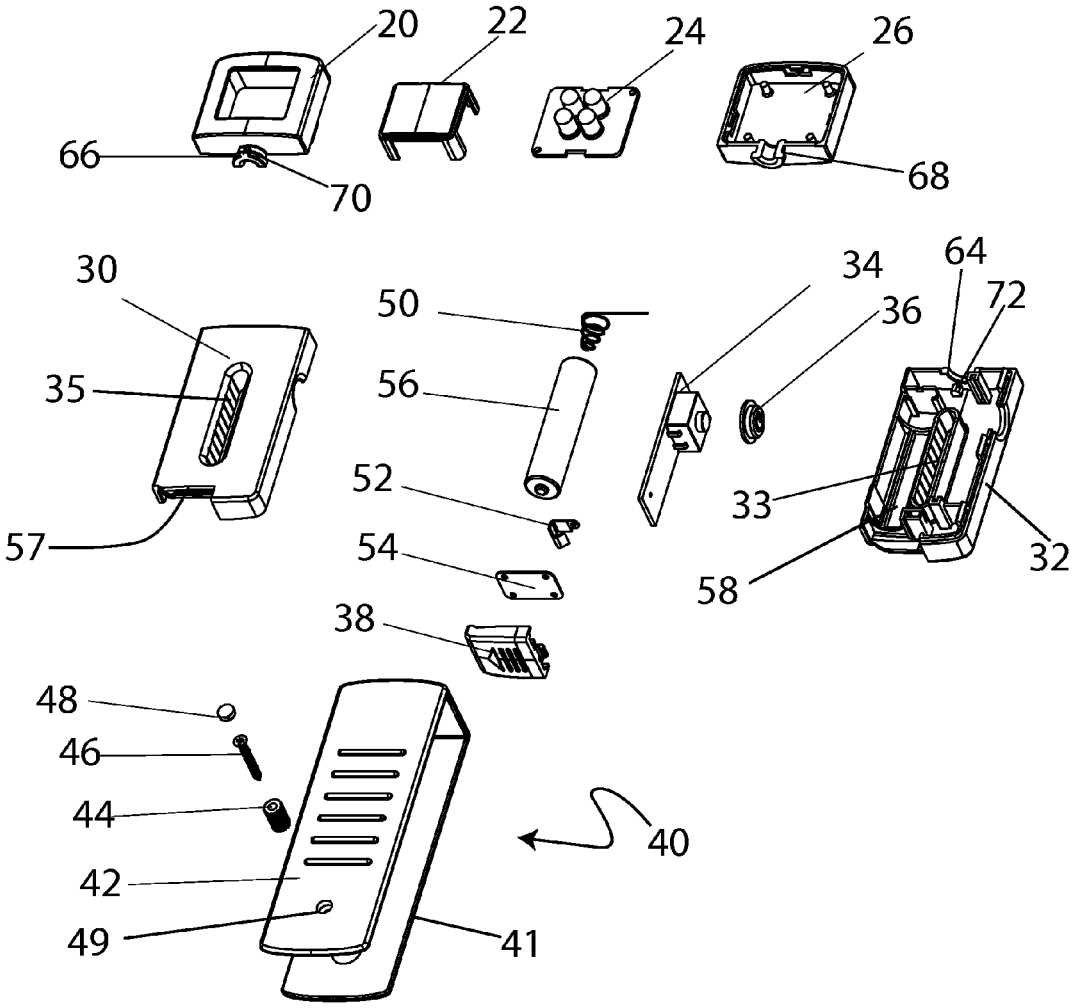
FIG. 3A is a perspective exploded view of a pocket light and its sheath.

FIG. 3A presents, in the first horizontal row, the components of the lamp section 15, being a lamp front cover 20, a lamp front cover neck 66, a lamp section stop 70, a lens 22, a light source (being an LED as shown in this illustration), and the lamp rear cover 26.

The second horizontal row of FIG. 3A displays the main front cover 30 and its integral front cover oval channel 33, a typical AA size battery 56, a spring battery terminal 50, a secondary battery terminal 52, a primary battery terminal 54, and a battery door 38, which door 38 slidingly fits into a notch 57 shown in the main front cover 30. To the right of the battery 56 is shown a control circuitry board 34 and a power switch 36, which work in conjunction with each other to establish the on or off flow of dc current from the battery 56 to the light source 24

Figure 3B:
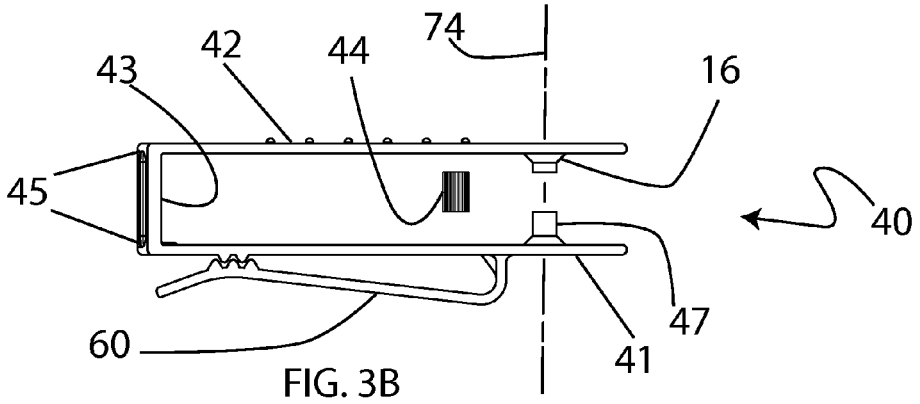
FIG. 3B presents a side view of the sheath member, with the grommet being separated.

Also depicted in the second horizontal row of FIG. 3A is an internal view of the main rear cover 32, displaying the rear cover oval channel 35, a battery compartment 58, the main rear neck 64, and a main body stop 72. The sheath 40 is shown in FIG. 3A, and FIG. 3B, including a threaded fastener 46, which, upon assembly of the pocket light 10, is inserted through the sheath hole 49 and through a fastener guide 16. The grommet 44 is thereupon placed in alignment with the slab nut 47, and the threaded fastener 46 is rotatingly secured into the slab nut 47. Afterwards, a cap 48 is placed into the sheath hole 49.

Figure 4:
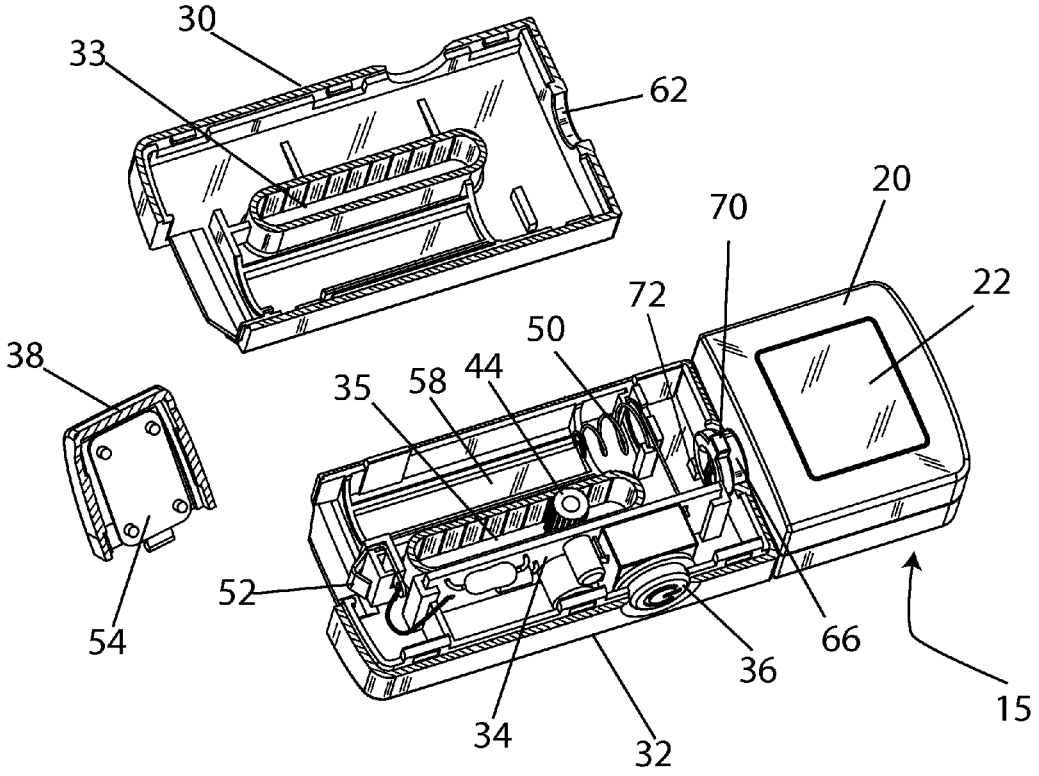
FIG. 4 is a perspective view of the internal components, cavities, and structure of the separated front cover, rear cover, and battery door of the main body, with the lamp shown assembled and attached to the main rear cover.

FIG. 4 depicts a close-up view of the internal configuration of the main front cover 30 and the main rear cover 32. The main front cover 30 and the main rear cover 32 have matching perimetral edges, and when the covers 30, 32 are juxtaposed onto each other, may be latched together by cooperation of plastic tabs along the edges of both covers 30, 32. The stop 70 and the lamp front neck 66 of the lamp section 15 are shown engaged with the stop 72 of the main rear cover 32, thus forming the "neck-and-collar" combination. The interior surface of the battery door 38 is comprised of the primary battery terminal 54, which, upon closing the battery door 38, engages with the secondary battery terminal 52. The secondary battery terminal 52 is wired directly to the control circuitry board 34. A battery compartment 58 is constructed for placement of a battery as the power source which, in turn, makes contact with the spring battery terminal 50. The spring battery terminal 50 is further soldered to the control circuitry board 34.

Wiring from the control circuitry board 34 travels through the lamp front cover neck 66 to the terminals of the light source 24 (not shown) positioned immediately under the lens 22. A power switch 36, which is electrically wired to the control circuitry board 34, is used to close or open a circuit for supplying current to the light source 24. In the preferred embodiment, as shown herein, the light source 24 is depicted as a light emitting diode (LED), however any appropriate lighting means may be used in the pocket light 10. From the positions shown in FIG. 4, the main front collar 62 and the main front cover 30 will be placed securely over the lamp front cover neck 66 and the main rear cover 32, respectively, forming a completely joined main body 18 and lamp section 15.

Figure 6A:
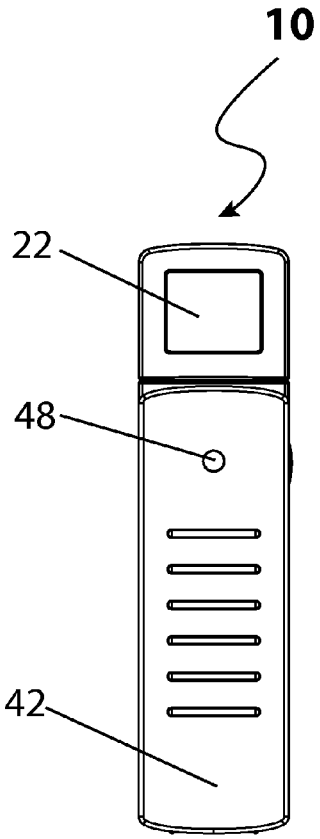
FIG. 6A is an elevation front view of the pocket light with the lamp section and main body partially extended from the storage position.
Figure 6B:
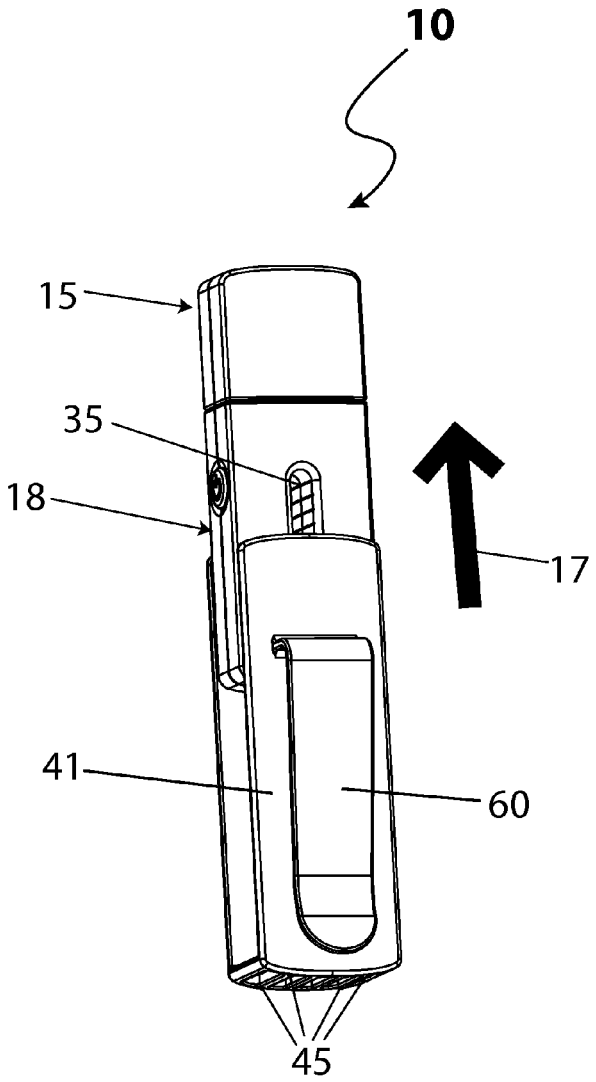
FIG. 6B is a perspective rear view of the pocket light with the lamp and main body section being longitudinally extended relative to the sheath.

FIG. 5 illustrates the 360 degree uninterrupted range of rotation 13 of the main body 18 as it pivots about the grommet axis 44, said axis co-located and aligned with the center of the cap 48, and also co-located with the extended axis of the threaded fastener 46. FIG. 5 further presents the manner in which the lamp section 16 rotates in a 300 degree arc about the extended main body collar axis 73. FIG. 6A presents a partially extended pocket light, while FIG. 6B depicts the main body 18 and lamp section 15 being fully longitudinally extended from their stored position within the sheath 40.

FIGS. 7A, 7B,7C, and 7D as explained earlier, present four varied means of arranging the pocket light 10 in a self-standing mode, which thereby provides illumination to an area where a task requires both hands of the user to accomplish.

FIG. 8A and FIG. 8B present two means of attachment of the pocket light 10 to common articles of clothing of a user. FIGS. 9A and 9B present the relative size of the pocket light 10 and the relative positioning of the lamp section partially extended and fully extended from the sheath.

FIGS. 10A,10B,10C,10D,10E and 10F represent the appearance of an alternative embodiment of pocket light 400 wherein the previously-mentioned oval channel 33, 35 become 433, 435 and is fabricated into the center portion of prong 442 and 441 of a differently-designed sheath 440. The lamp section 415 is exactly the same as lamp section 15 of the preferred embodiment of pocket light 10 while the main body section 418 does not have oval channels as main body section 18 of the preferred embodiment.

Figure 10A:
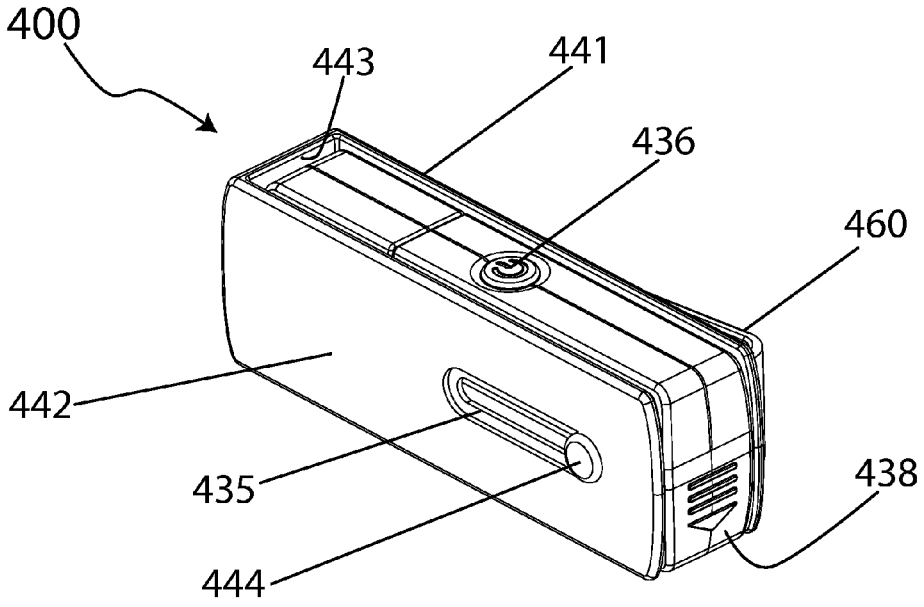
FIG. 10A is a perspective view of the pocket light according to an alternate embodiment of the present invention with the lamp section and main body section in storage position within the prongs.
Figure 10B:
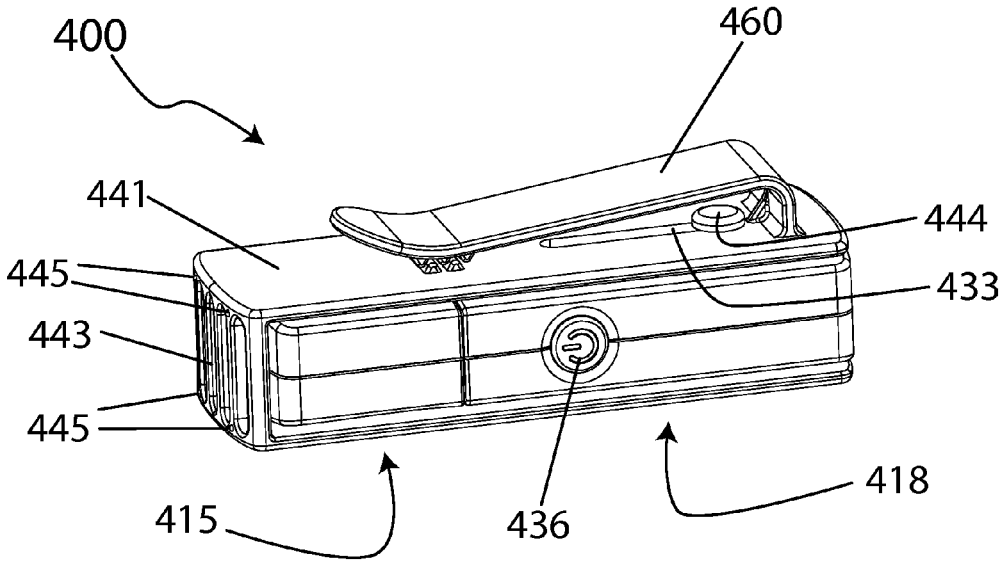
FIG. 10B is a perspective view of a pocket light according to an alternate embodiment of the present invention with an integral clip showing on one side of the sheath member.

FIGS. 10A and 10B present the alternate embodiment of pocket light 400 in its stowed, or compacted configuration. The pocket light clip 460 shown in FIG. 10B is a useful feature that enables a user to actively use the pocket light 400 as same as the preferred embodiment of the pocket light 10 previously discussed. The power switch 436 has similar function as power switch 36 (shown in FIG. 1A and FIG. 1B).

Figure 10C:
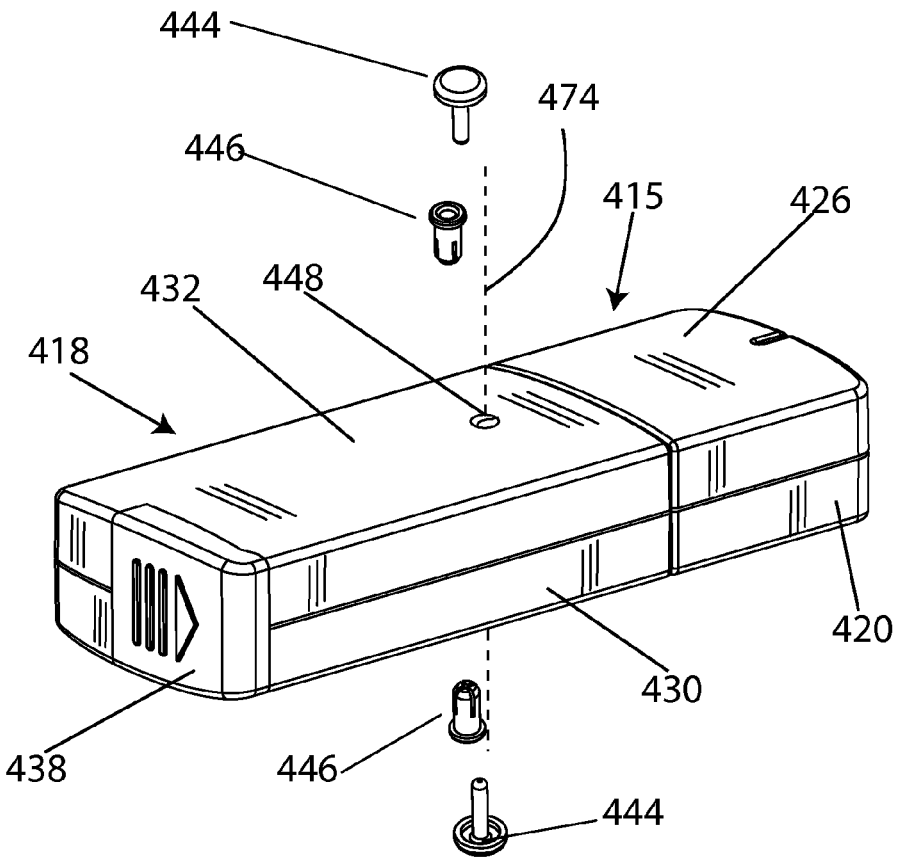
FIG. 10C is a perspective view of the pocket light according to an alternate embodiment of the present invention with lamp, main body section, anchors, cover plugs separated from the sheath member, with the lamp section and main body section are in a semi-storage position.
Figure 10D:
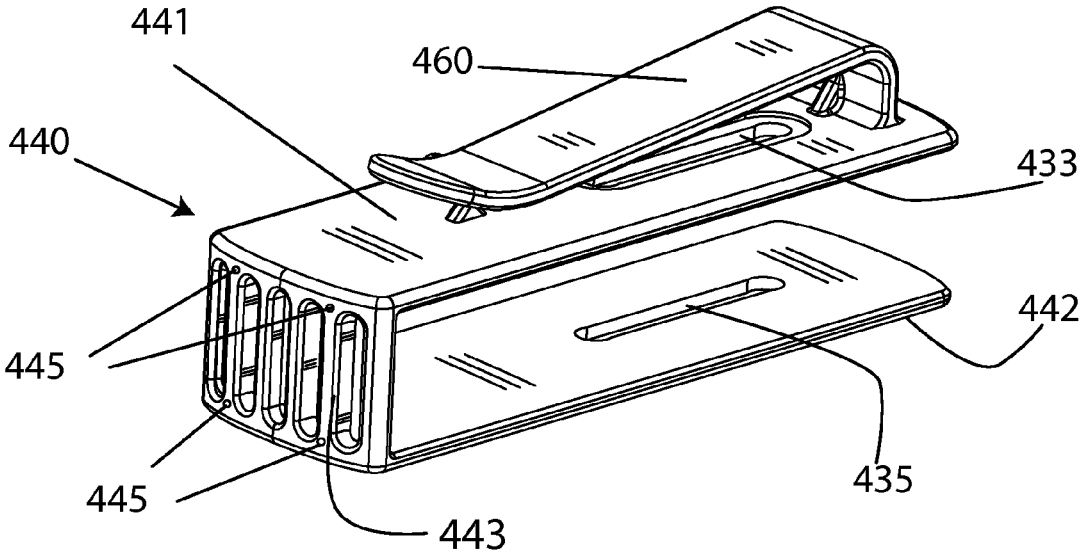
FIG. 10D depicts the two-pronged sheath member of a pocket light according to an alternate embodiment of the present invention.

The key difference between the preferred and alternate embodiment of the invention can be shown in FIG. 10C and FIG. 10D. FIG. 10C shows the lamp section 415, having a front lamp cover 420 and a rear lamp cover 426. The lens of the pocket light 400 (not shown) is same as the lens 22 (shown in FIG. 3A). The lamp section 415 and the main body section 418 are releasably joined together by the pivotal union construction as the preferred embodiment of the present invention (shown in FIG. 3A).

FIG. 10D illustrates the sheath 440 which is constructed so as to enclose, lengthwise, the main body 418 and lamp section 415 between the upper prong 441 and lower prong 442 of the sheath 440. In a fully-stowed configuration, the conjoined main body 418 and lamp section 415 are placed lengthwise within sheath 440. The rotation axis 474 with similar function as axis 74 (shown in FIG. 2) is aligned with the center of through-hole-opening 448. In this manner, anchor 446 passes through the oval opening 433 and is inserted into the through hole opening 448. Another anchor 446 passes through oval opening 435 and is inserted into the through hole opening 448 on the other side. Fasteners 444 are then inserted into the center of anchors 446 and keep the main body section 418 secured within the sheath 440.

Figure 10E:
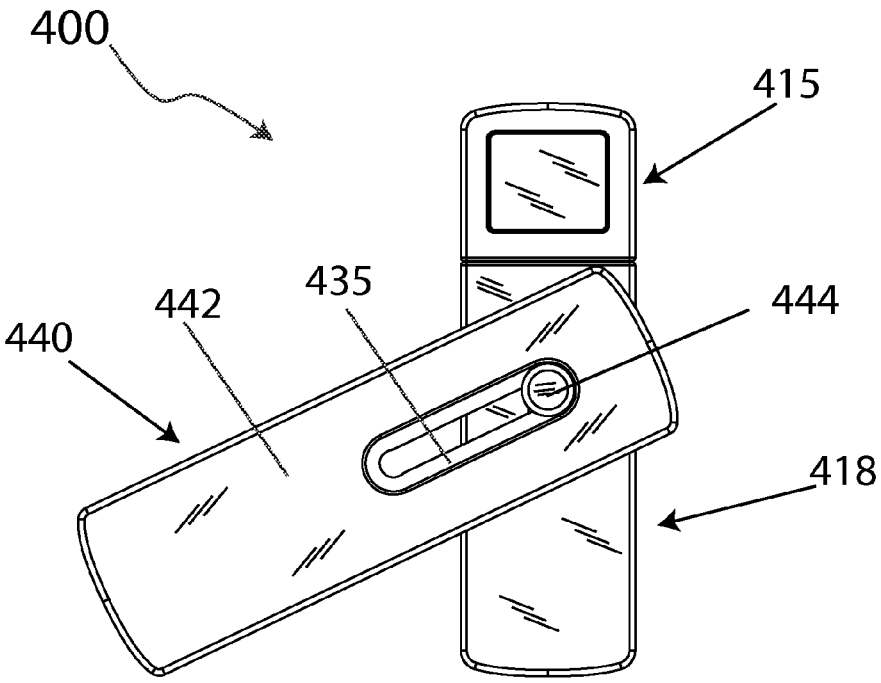
FIG. 10E is a front view of a pocket light with built-in clip in the open position according to an alternate embodiment of the present invention.
Figure 10F:
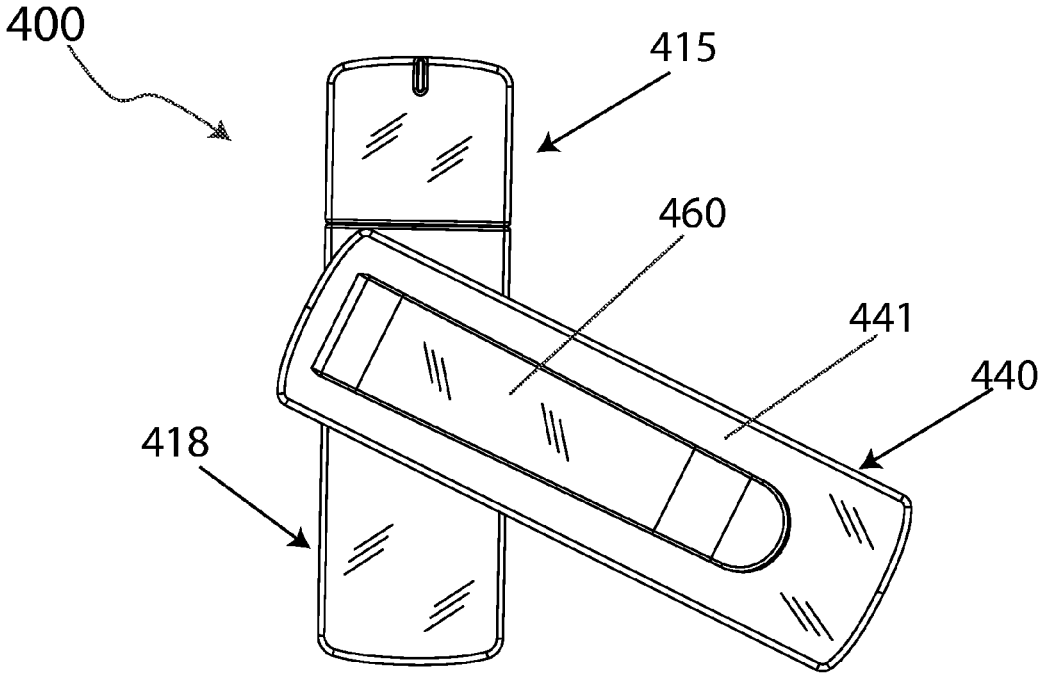
FIG. 10F is a back view of a pocket light with built-in clip in the open position according to an alternate embodiment of the present invention.

Once the pocket light 400 is secured within the sheath 440, the main body 418 is enabled to rotate, in a complete 360 degree arc, about the axis 474, and within the confines of the upper and lower prongs 441, 442 as the preferred embodiment of the invention described above. The alternate embodiment of the pocket light 400 can be oriented in similar ways as the preferred embodiment of the pocket light 10 shown in FIGS. 7A, 7B and 7C. However, the alternate embodiment of the pocket light 400 cannot be deployed the same way as the pocket light 10 as shown in FIG. 7D. FIGS. 10E and 10F shows one of the orientations when the alternate embodiment of the pocket light 400 deployed and rested on a level surface by the bottom section of the main body 418 and the sheath back 443.

While preferred embodiments of the present inventive concept have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the scope and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions and not limited by the scope of the claims presented herein.

What is claimed is:

1. A pocket light comprising a first member being a main body, a second member being a lamp section, and a third member being a two-pronged sheath, wherein:

said main body comprises a main front cover and a rear cover to form an enclosure, whereupon both main covers being closed and latched onto each other, form an opening through channel common to the main front cover and the main rear cover and a main stop;

said lamp section comprises a front lamp cover, a rear lamp cover, a lamp front neck, a lamp rear neck and a lamp stop, wherein said lamp section is attached to said main body such that said lamp section may rotate about an extended axis of said body; and said sheath comprises an upper prong, a lower prong, a back, a slab nut, a fastener guide, a sheath hole, a grommet, a threaded fastener, and a cap, wherein said main body is attached between said upper prong and lower prong such that said main body may rotate unimpaired, three hundred sixty (360) degrees within the confines of said upper and lower prongs; whereby said pocket light, upon being assembled, may utilize an appropriately-sized battery for powering said light source and thereupon enabling light emissions from said light source to be directed, aimed and oriented in a plurality of combinations of relative orientations of said main body, lamp section, and sheath.

2. A pocket light as in claim 1, further comprising a spring-loaded clip permanently attached to the outer surface of said upper prong.

3. A pocket light as in claim 1, further comprising footings on the connected end of said two-pronged sheath to allow self-standing on level surface.

4. A pocket light as in claim 1, further comprising at least one light emitting diode.

5. A pocket light as in claim 1, further comprising an incandescent lamp.

6. A pocket light as in claim 1, further comprising a control circuit to power at least one light emitting diode with at least one single cell battery.

7. A pocket light comprising a first member being a main body, a second member being a lamp section, and a third member being a two-pronged sheath, wherein:

said main body comprises a main front cover and a main rear cover having matching perimetral edges, whereupon both covers, upon being closed and latched onto each other, enclose a battery compartment, a battery door, a control circuitry board, and a power switch;

said lamp section comprises a front lamp cover, and a rear lamp cover, whereupon both of said lamp covers, upon being closed and latched onto each other, enclose an electric terminal, a light source, a lens, and a means for attaching said lamp section to said main body such that said lamp section may rotate about an extended axis of said main body; and said sheath comprises an upper prong, a lower prong, a back, and a means for pivotally attaching said main body between said upper prong and lower prong such that said main body may rotate unimpaired, three hundred sixty (360) degrees within the confines of said upper and lower prongs; whereby said pocket light, upon being assembled, may utilize an appropriately-sized battery for powering said light source and thereupon enabling light emissions from said light source to be directed, aimed and oriented in a plurality of combinations of relative orientations of said main body, lamp section, and sheath.

8. A pocket light as in claim 7, further comprising a spring-loaded clip permanently attached to the outer surface of said upper prong.

9. A pocket light as in claim 7, further comprising footings on the connected end of said two-pronged sheath to allow self standing in level surface.

10. A pocket light as in claim 7, further comprising at least one light emitting diode.

11. A pocket light as in claim 7, further comprising an incandescent lamp.

12. A pocket light as in claim 7, further comprising a control circuit to power at least one light emitting diode with at least one single cell battery.

13. A method of illuminating an area, comprising the steps of: providing a portable luminaire assembly comprising a first member being a main body, a second member being a lamp section, and a third member being a two-pronged sheath, wherein:

said main body comprises a main front cover and a main rear cover having matching perimetral edges, whereupon both covers, upon being closed and latched onto each other, enclose a battery compartment, a battery door, a control circuitry board, and a power switch;

said lamp section comprises a front lamp cover, a rear lamp cover, whereupon both of said lamp covers, upon being closed an latched onto each other, enclose an electric terminal, a light source, a lens, and a means for attaching said lamp section to said main body such that said lamp section may rotate about an extended axis of said main body; and said sheath comprises an upper prong, a lower prong, a back, footings, and a means for pivotally attaching said main body between said upper prong and lower prong such that said main body may rotate unimpaired, three hundred sixty (360) degrees within the confines of said upper and lower prongs; whereby said luminaire assembly, upon being assembled, may utilize an appropriately-sized battery for powering said light source and thereupon enabling light emissions from said light source to be directed, aimed and oriented in a plurality of combinations of relative orientations of said main body, lamp section, and sheath.

14. The method of illuminating of claim 13, further comprising a spring-loaded clip permanently attached to the outer surface of said upper prong.

15. The method of illuminating of claim 13, further comprising footings on the connected end of said two-pronged sheath to allow self standing in level surface.

16. The method of illuminating of claim 7, further comprising at least one light emitting diode.

17. The method of illuminating of claim 13, further comprising an incandescent lamp.

18. The method of illuminating of claim 13, further comprising a control circuit to power at least one light emitting diode with at least one single cell battery.

* * * * *